US005969472A

United States Patent [19]

Kisner

[11] Patent Number: 5,969,472

[45] Date of Patent: Oct. 19, 1999

[54] LIGHTING SYSTEM OF ENCAPSULATED LUMINOUS MATERIAL

[75] Inventor: Roger Allen Kisner, Knoxville, Tenn.

[73] Assignee: Lockheed Martin Energy Research Corporation, Oak Ridge, Tenn.

[21] Appl. No.: 08/984,211

[22] Filed: Dec. 3, 1997

[51] Int. Cl.[6] ..... H01J 1/62

[52] U.S. Cl. ..... 313/484; 313/491; 313/506; 313/634; 313/637

[58] Field of Search ..... 313/484, 491, 313/492, 493, 501, 506, 634, 637

[56] References Cited

U.S. PATENT DOCUMENTS

| | | | |
|---|---|---|---|
| 4,667,008 | 5/1987 | Webb . | |
| 4,675,577 | 6/1987 | Hanlet . | |
| 4,866,351 | 9/1989 | Yazaki . | |
| 5,041,762 | 8/1991 | Hartai . | |
| 5,326,298 | 7/1994 | Hotomi | 313/582 |
| 5,382,879 | 1/1995 | Council et al. . | |
| 5,461,279 | 10/1995 | Hasegawa . | |
| 5,469,020 | 11/1995 | Herrick | 313/511 |

*Primary Examiner*—Vip Patel
*Attorney, Agent, or Firm*—Quarles & Brady LLP

[57] ABSTRACT

A lighting system includes an electrically insulating and transparent or translucent optical material having a plurality of compartments containing a luminous composition, forming a light-emitting material. Structure for passing radiation, preferably radio frequency radiation, through the compartments is provided such that the luminous composition in the compartments will emit light through the optical material. The luminous composition is preferably a gas that is entrained as bubbles in the optical material when it is in the liquid state. The optical material is hardened to seal within the luminous gas and to produce a light-emitting material. Electrodes are used to pass the RF radiation through the light-emitting material. The electrodes can be provided as an adhesive-backed foil which is attached to the light-emitting material.

24 Claims, 5 Drawing Sheets

LIGHTING SYSTEM OF ENCAPSULATED LUMINOUS MATERIAL

FIELD OF THE INVENTION

This invention relates generally to lighting, and more particularly to lighting utilizing a luminous composition such as a luminous gas.

BACKGROUND OF THE INVENTION

Current fluorescent and neon lights are easily broken, and when broken, the entire light will not function. These lights also suffer from the disadvantage that it is relatively difficult to form the lights in irregular shapes. It is also difficult to achieve large areas of planar light. The lights are cumbersome and heavy, and relatively high-cost to fabricate. There is a need for lighting which is durable, has high efficiency and long life, is light-weight, and can be produced at a reasonable cost.

Several consumer, commercial and industrial markets desire curved and flat light panels that are energy efficient, lightweight, rugged, long-lived, and survivable. The automobile industry, for example, has a need for improved brake, turn-signal and back-up lights that can be fashioned more flexibly than current incandescent technology will permit. Also, decorative and panel lighting requires more stylistically-shaped lighting systems than is possible with the bulky and inflexible framework of fluorescent technology. It is also desirable in some uses, such as defense, outdoor, and safety uses, that the light be able to function even after a damaging impact.

SUMMARY OF THE INVENTION

The invention provides a lighting system having an electrically insulating and optically transparent or translucent material (hereinafter an "optical" material), in which there is formed a plurality of compartments containing a luminous composition such as a luminous gas. Structure for passing radiation, preferably radio frequency (RF) radiation, through at least a portion of the compartments is provided. The RF radiation causes the luminous composition in the compartments to emit light through the optical material.

The luminous composition can be selected from a number of suitable compounds, or mixtures of compounds, which will generate light when exposed to RF radiation. Currently preferred are luminous gasses such as neon and krypton. Liquid, gelatinous or solid luminous compositions are also possible.

The optical material is selected from a durable, optically transparent or translucent and substantially insulating material. Glass is currently preferred, however, transparent or translucent polymer materials are also suitable.

The lighting system can be manufactured by entraining bubbles of a luminous gas in the optical material when it is in the liquid or molten state. The optical material is then solidified, trapping the gas at low pressure in the optical material. The lighting system can also be made according to alternative methods. Enclosed capsules of spheres, tubes, or other shapes can be formed so as to contain the luminous composition. These enclosed capsules can be embedded in the optical material in selected sizes, concentrations, arrangements, colors, and the like to control the characteristics of the resulting lighting system. In still another embodiment, the lighting system can be constructed by the use of pre-formed sections which, when joined together, form numerous enclosed capsules containing the luminous composition.

Materials can be added to improve the performance or characteristics of the lighting system. Fluorescent and phosphorescent coatings can be applied to the surfaces of the compartments in order to improve the efficiency and operating characteristics of the lighting system. Other materials can be added to alter the color or intensity of the light that is emitted.

Suitable structure is provided to pass a RF radiation through the compartments. Electrodes can be attached to the outside surface of the optical material, through which the RF radiation can be applied to the luminous composition in the compartments. The electrodes can be provided as a conductive foil of metal or conductive polymers. The electrodes can be arranged in a pattern that cancels stray radiation and yet delivers energy to the luminous composition. Shielding can be added to reduce electromagnetic interference (EMI).

Some optical materials can be liquified and formed into a variety of shapes before they have hardened. The invention is especially useful to create lighting in irregular shapes, such as the curved form of automobile tail lights. Light will be emitted relatively evenly from the curved surfaces of such lights because the compartments can be distributed evenly through the optical material. Also, the finished light-emitting material can be cut into blocks, which can be adhered or fixed together in any desired shape or size.

BRIEF DESCRIPTION OF THE DRAWINGS

There are shown in the drawings embodiments which are presently preferred, it being understood that the invention is not limited to the precise arrangements or instrumentalities shown, wherein.

DETAILED DESCRIPTION OF THE PREFERRED EMBODIMENTS

Figure 1:
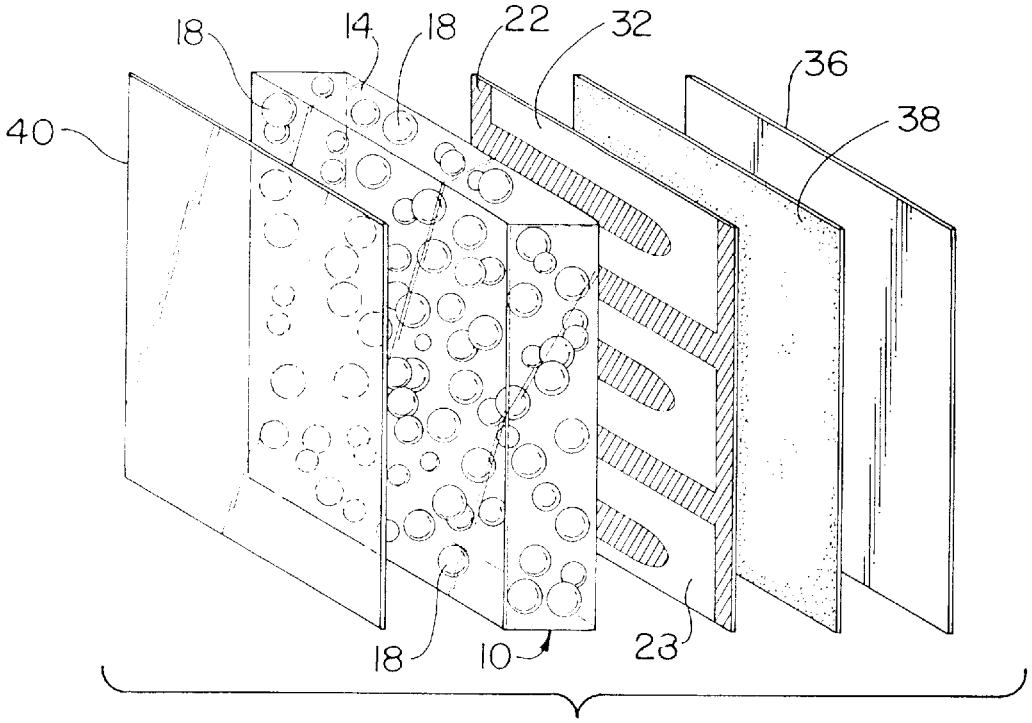
FIG. 1 is an exploded view of a lighting system according to the invention.
Figure 2:
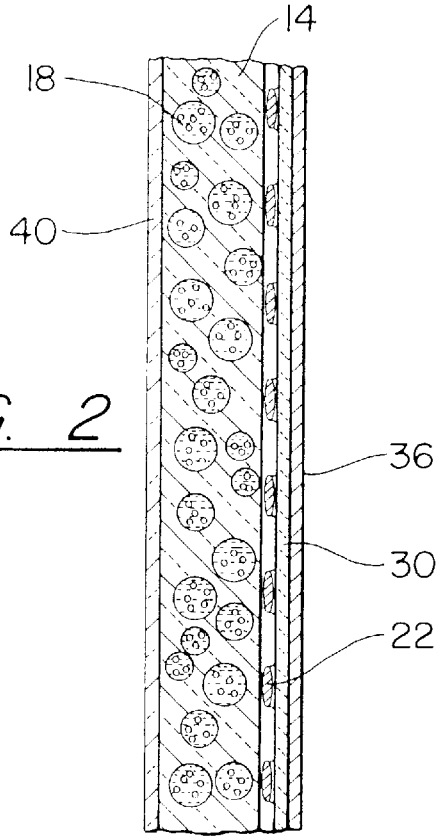
FIG. 2 is a cross section through a lighting system according to the invention.

There is shown in FIGS. 1–2 a lighting system according to the invention. The lighting system principally comprises a transparent or translucent optical material 14 which has a plurality of compartments 18 containing a luminous composition. The optical material 14 and compartments 18 together form a light-emitting material 10 which will emit light when subjected to radio-frequency (RF) radiation. Electrodes are provided to pass an RF excitation through the optical material 14, to cause the luminous composition to emit light.

The compartments 18 can be formed by any suitable technique, including molding techniques, but are preferably formed by bubbling a luminous gas into the optical material 14 when the optical material is in the liquid state. This will produce a light-emitting material 10 in the general form of a foam which, when hardened, will have numerous bubbles of luminous gas trapped within the rigid optical material. The bubble or compartment size is preferably larger than the electron mean-free-path in the luminous gas when it has been ionized by the RF radiation. This will improve efficiency by promoting atomic interactions. Compartments that are too large in volume may be difficult to completely ionize and cause light emission. Compartments that are too small do not provide enough electron mean-free path length for efficient emission. Currently preferred compartment sizes for lighting uses are between about 1 mm and about 1 cm. The bubbles can be evenly distributed throughout the volume of the light-emitting material 10, or can be more densely collected in certain spots to vary the luminosity of the material from place to place.

The luminous composition, if a gas, can be selected from any suitable gas which will emit light when subjected to RF radiation. Currently preferred single gasses include neon, xenon and krypton. A single luminous gas may be used, or mixtures of luminous gasses. Other materials can also be used with the luminous gas, which materials can impart brightness, color, or other characteristics to the light. Examples of such other materials include mercury and sodium. The luminous composition can alternatively be selected from liquids, semi-solids such as gelatinous materials, or solids which will emit light when subjected to RF radiation.

The optical material 14 can be selected from any suitable compound, or combinations of compounds, which is transparent or translucent, is substantially electrically insulating, and can retain the luminous composition in the compartments 18 without leakage. Glass and polymers are currently preferred. Other suitable materials include transparent or translucent polymers.

The electrodes can be of any design or construction that is suitable for passing RF radiation through the optical material 14. In the embodiment shown, an electrode foil 22 is provided which has a series of electrodes 28, 30 and 32 etched or cut into it to distribute the RF energy through the optical material 14 as required. In certain circumstances, the luminous gas may be difficult to initiate discharge, and a separate high voltage circuit path that runs across the light-emitting material 10 can be provided in the foil 22 to conduct a starting voltage or spark to start the ionization process. The electrodes can be made from any suitable conductive material, such as aluminum, copper or other metals, as well as conductive plastics.

The electrodes can be attached to the optical material 14 by an adhesive backing, or can be formed in or molded into the optical material 14. The installation of electrodes by the application of an adhesive-backed foil or conductive polymer will reduce assembly costs and waste.

The RF excitation can be provided by a high frequency AC-to-AC or DC-to-AC converter. The frequency is selected to cause the luminous gas to ionize and emit light. Suitable frequencies may range from about 200 kilohertz to about 30 megahertz. The RP converter source can be housed in a small module using semiconductor technology. The power module can be made small due to the high frequency of the output waveform. Miniature excitation circuits can be built into the optical material 14 to simplify installation.

Fluorescent or phosphorous materials may be provided on the inside of the compartments 18 to increase light output or alter the chromatic content. A fluorescent material will capture energetic electrons from the ionized luminous gas, and convert the energy to additional photons. Thus, the energy of these captured energetic electrons will provide additional light, rather than having this energy thermalized and lost.

Shielding may be required to prevent electro-magnetic interference (EMI) in nearby systems. The shielding can be achieved by electrode placement using dipole cancellation techniques in the electrode foil 22, and also by field blocking using conductive films and foils on all exposed sides. The electrodes can be arranged in a pattern that cancels stray radiation and still delivers energy to the luminous gas. A conductive shielding film 36 of metal is shown in the drawings. An insulator film 38 is placed between the shielding material 36 and the electrode foil 22. Shielding 40 is provided on the viewing side of the lighting system, and therefore must be transparent. This shielding is preferably formed of a conductive transparent film such as metal oxides or conductive polymers.

The lighting system of the invention can be manufactured by different methods. In a preferred method, the optical material, or reactants which will create the optical material, are in the liquid state. The luminous gas is mixed with the liquid, preferably to saturation. The liquid is then hardened and traps the luminous gas within in a plurality of compartments or bubbles. Bubble size, bubble density, and gas pressure within the bubble can be utilized to control the distribution of the luminous gas in the optical material and the resulting luminosity of the product. Other ingredients or materials can be added at this stage. The gas is preferably low density and can be whipped, foamed, or otherwise entrained in the liquid. The liquid is preferably molten glass, and the entrainment of the gas in the glass creates a glass foam. Any internal coatings must be mixed with the luminous gas and/or the liquid optical material such that it will aggregate at the boundary of the liquid-bubble interface to coat the bubble with the coating. The gas pressure is preferably between about 1 torr and about 20 torr, depending on the type of gas that is used. A gas pressure that is too high can result in an electron mean-free-path in the ionized gas that is too short. A gas pressure that is too low, below about 0.5 torr, will not permit enough current to flow for the device to operate properly. The invention can be made by a continuous process where the liquid material is injected into molds.

Figure 3A:
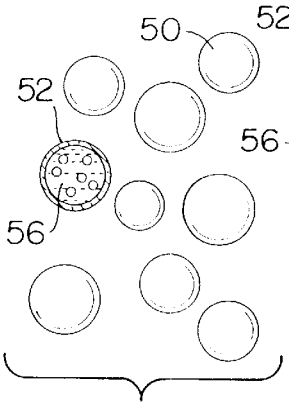
FIG. 3*a* is a side elevation, partially broken away, of spherical capsules of an alternative embodiment of the invention.
Figure 3B:
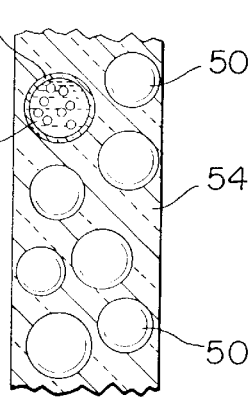
FIG. 3*b* is a side elevation of the capsules of FIG. 3*a* as embedded in an optical material.

The light-emitting material can be poured, molded, extruded, rolled or otherwise formed prior to hardening. Thus, products such as curved or flat panels of varying dimensions can be readily obtained. For example, a simple rectangular panel can be fabricated to have 0.25 to 1.0 centimeters thickness and dimensioned so as to fit suspended ceilings. The material can also be made into irregular shapes, such as the shape of curved brake lights for automobiles. Proper gas collection and colorizing of the transparent material can be used to control the color of the emitted light. For example, neon can be the entrained gas to create SAE red for brake and rear driving lights for automobiles. Also, the light-emitting material can be formed as blocks, or in other shapes, which can be adhered or fastened together in any desired shape. There is shown in FIGS. 3*a–b* an alternative embodiment of the invention in which luminous spheres comprised of an optical material and luminous gas are provided. The luminous spheres 50 are comprised of an outer spherical shell 52 of an optical material. Enclosed within the outer shell is a luminous gas 56. The luminous spheres 50 can be made of different sizes, and can have different luminous gases 56 so that different colors will be produced when the RF energy is applied. The luminous spheres 50 can be pre-formed and used as needed to make light-emitting material according to the invention.

The luminous spheres 50 are embedded within an optical material 54 (FIG. 3*b*). The optical material 54 can be the same optical material comprising the outer shell 52, or can be made of a different optical material. The luminous spheres 50 can be positioned in the optical material 54 according to pre-determined patterns of color, luminosity, arrangement, and the like, or can be mixed randomly or homogeneously in the optical material. The luminous material created thereby will generate light when RF energy is applied. The RF energy can be applied by electrodes or other sources, as previously described.

Figure 10A:
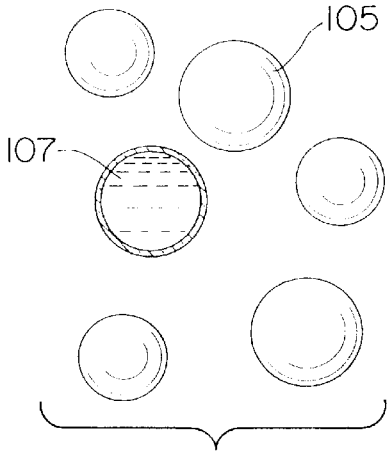
FIG. 10*a* is a side elevation, partially in cross section, of an embodiment of the invention having spherical capsules and a liquid luminous composition.
Figure 10B:
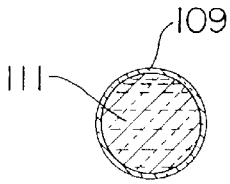
FIG. 10*b* is a cross section of spherical capsules according to the invention having a semi-solid luminous composition.
Figure 10C:
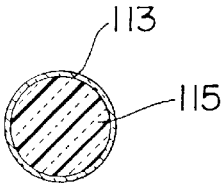
FIG. 10*c* is a cross section of a spherical capsule according to the invention having a solid luminous composition.

The capsules can be used to contain a luminous composition that is liquid, semi-solid, or solid. This is shown in FIGS. 10*a–c*. A capsule 105 contains a liquid luminous composition 107 (FIG. 10*a*). A capsule 109 contains a semi-solid gelatinous composition 111 (FIG. 10*b*). A capsule 113 contains a solid luminous composition 115 (FIG. 10*c*).

Figure 4:
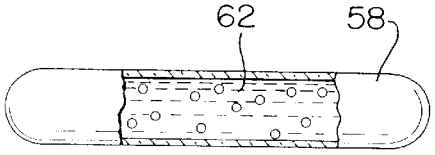
FIG. 4 is a side elevation, partially broken away, of a luminous tubular capsule.
Figure 5:
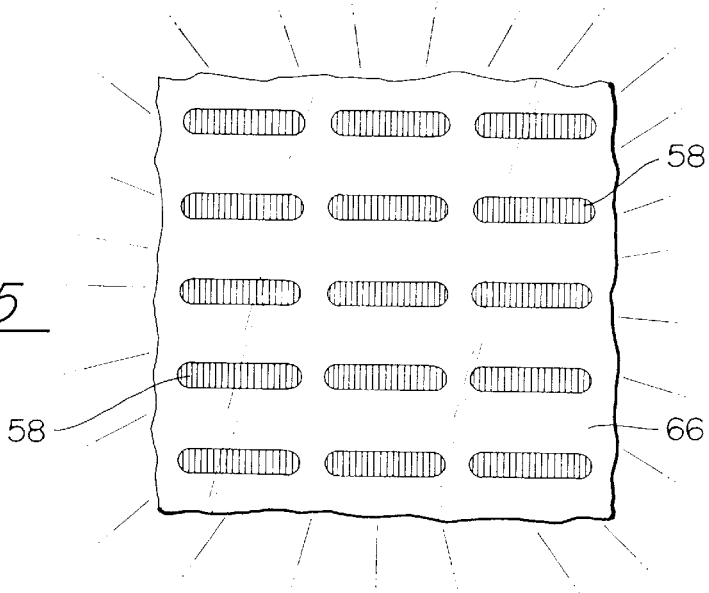
FIG. 5 is a front elevation of an alternative embodiment using the luminous tubular capsule of FIG. 4.
Figure 6:
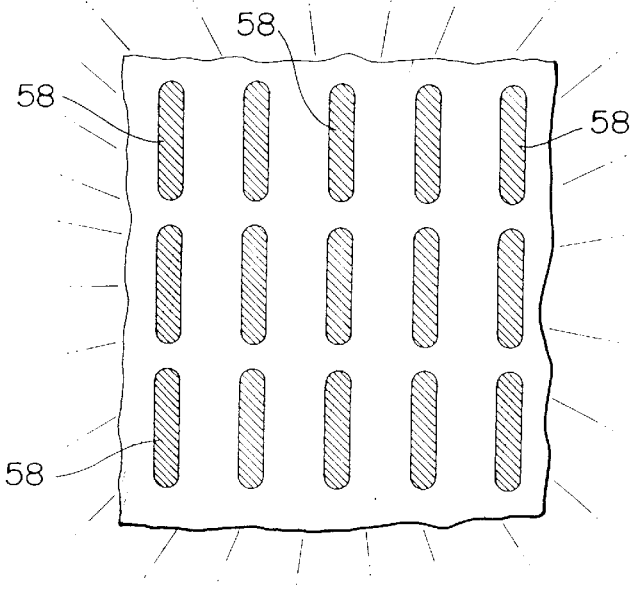
FIG. 6 is an alternative arrangement of the tubular capsules of FIG. 4.

The spheres present a common geometrical shape which can be produced according to known encapsulation technology. It should be appreciated, however, that enclosed capsules of an optical material, and containing a luminous composition, can take almost any desired shape. A tubular capsule 58 is shown in FIG. 4, and contains a luminous gas 62. The tubular capsule 58 can be embedded in an optical material 66, as shown in FIGS. 5–6. In FIG. 5, luminous tubular capsules 58 having, for example, a red luminous gas are embedded substantially horizontally. In FIG. 6, tubular capsules having a green luminous gas are embedded substantially vertically. It will be appreciated that different combinations of arrangements of the tubular capsules 58, when combined with different colors produced by the luminous gas within the capsules 58, can be used to create very different visual effects within a solid light-emitting material.

Figure 7:
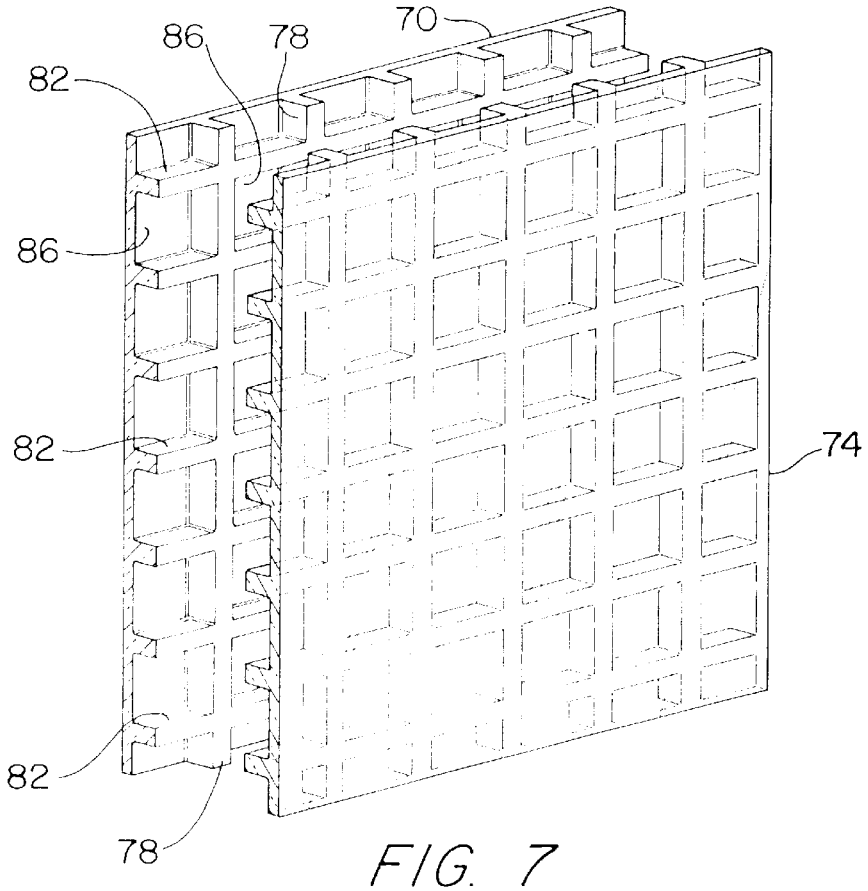
FIG. 7 is a perspective view of pre-formed sections for use in the assembly of another alternative embodiment of the invention.
Figure 8:
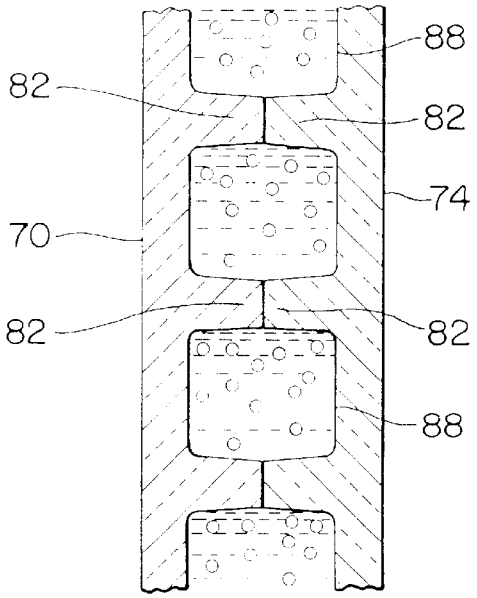
FIG. 8 is a cross section of the embodiment of FIG. 7, as assembled.

Another alternative embodiment of the invention is shown in FIGS. 7–8. In this embodiment, pre-formed sections 70, 74 are made of an optical material and are provided with mating portions which, when mated, form a plurality of enclosed chambers. The sections 70, 74 can be secured together in an atmosphere containing the luminous gas, such that the enclosed chambers will be formed with the luminous gas sealed inside. In the embodiment that is shown, each of the sections has raised vertical ribs 78 and horizontal ribs 82, which together form partial compartments 86. The sections 70, 74 are aligned during assembly such that the respective rib portions of each section mate with one another. The process is performed in an atmosphere of the luminous gas. Suitable hermetic sealing structure, such as an adhesive, is used to seal the rib portions together, so as to form a plurality of enclosed compartments 88 (FIG. 8) which contain the luminous gas 90. Alternative structure to introduce the luminous gas into the enclosed chambers, such as a mechanical gas injection apparatus, could also be utilized. Electrodes or other RF sources can be provided as previously described.

Figure 9:
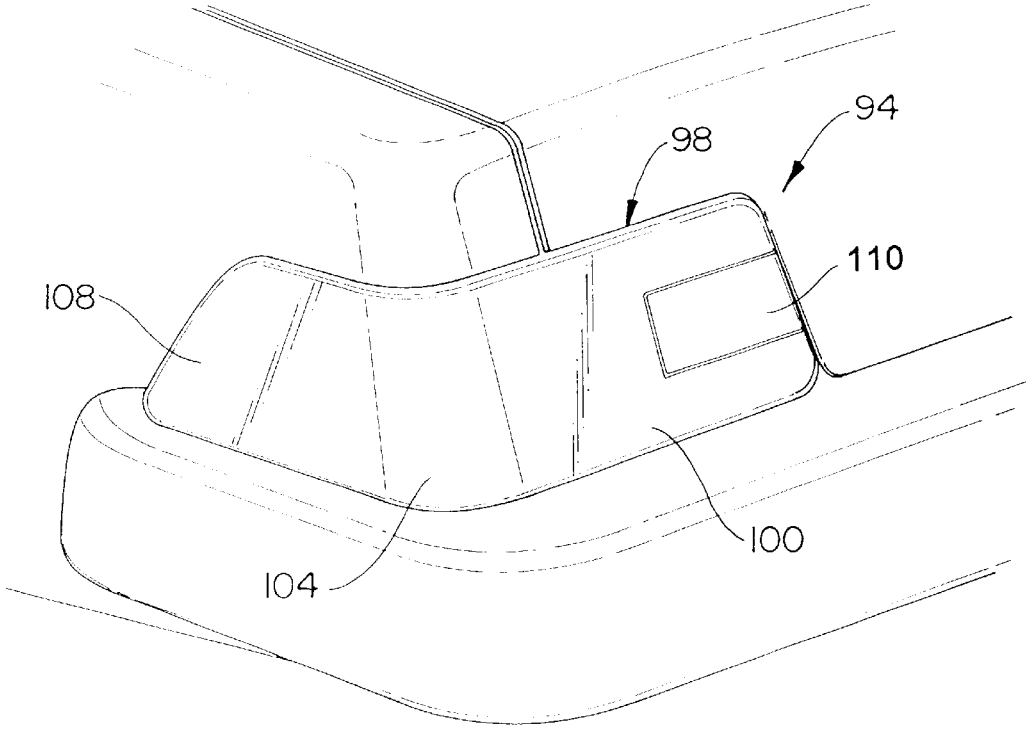
FIG. 9 is a perspective view of an automobile tail light assembly made according to the invention.

Lighting systems according to the invention are economically scalable to large panels and curved surfaces. For example, current optical systems cannot radiate as large planar areas due to the tubes or channels found in common commercial light products. The invention permits the construction of large lighted areas, and by controlling bubble or capsule placement and size, the luminosity across the panel can also be varied and controlled. Difficult curved lighting systems such as automobile tail lights are possible, as shown in FIG. 9. The tail light 98 is provided on automobile 94 and has planar portions 100 and 108, and an intermediate curved portion 104. The portions 100, 104, and 108 can be made of a light-emitting material containing an encapsulated, red-emitting luminous gas, so as to provide a brake light function. The portion 10 can be provided with a white-emitting luminous gas to serve as a back-up light. The invention makes possible the molding of the light so as to emit light more evenly from the curved and planar portions than has been possible with conventional tail light devices.

Figure 11:
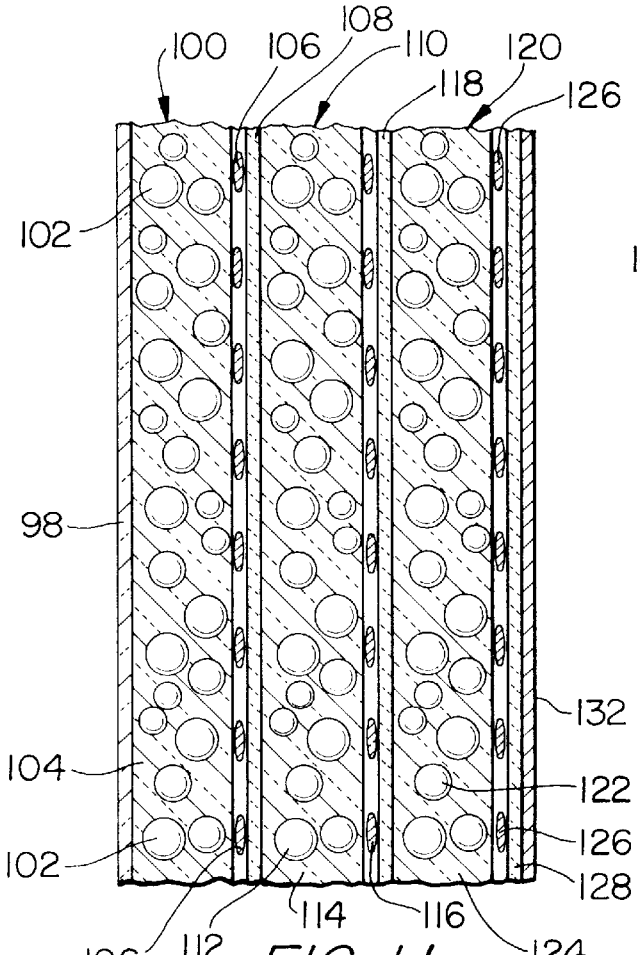
FIG. 11 is a cross section of an alternative embodiment having layers of light-emitting material according to the invention.

The electrodes, light-emitting material 10, and insulation can be layered to produce different lighting effects. This is shown in FIG. 11. A light-emitting material 100 according to the invention has a first layer of insulation 98. Compartments 102 containing a luminous composition are embedded in an optical material 104. Electrodes 106 supply RF radiation to the light-emitting material 100. A layer of transparent insulation 108 keeps the RF radiation directed through the light-emitting material 100, and away from adjacent layers. A second layer has a light-emitting material 10 with compartments 112 containing a luminous composition embedded in an optical material 114. Electrodes 116 supply RF radiation to the light-emitting material 110. A layer of transparent insulation 118 keeps the RF radiation directed through the light-emitting material 110, and away from adjacent layers. A third layer has a light-emitting material 120 with compartments 122 containing a luminous composition embedded in an optical material 124. Electrodes 126 supply RF radiation to the light-emitting material 120. A layer of transparent insulation 128 keeps the RF radiation directed through the light-emitting material 120. A number of desired layers can be constructed in this manner. An opaque backing layer 132 can be provided to prevent the emission of light from the rear of the lighting system.

The compartments 102, 112, and 122 can be differently sized, can have different luminous materials, and can have different coatings. The optical materials 104, 114, and 124 can be different, and each light-emitting material 100, 110, and 120 can have a different thickness and shape. The intensity of each layer can be separately controlled by the separate electrodes 106, 116, and 126. The insulation layers prevent the RF radiation from effecting adjacent layers. Alternatively, the insulation layers can be omitted to permit an electrode to pass RF radiation through both adjoining layers. This enables lighting systems to be designed and created that will emit specific combinations of light at different intensities.

Figure 12:
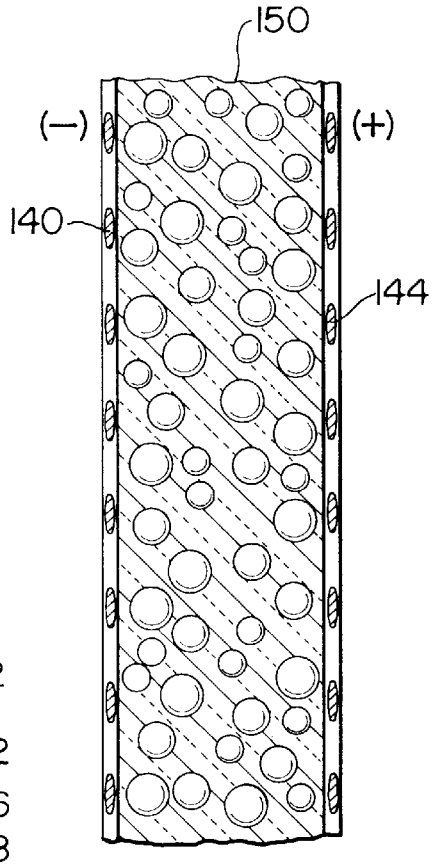
FIG. 12 is a cross section of an alternative embodiment having RF producing electrodes on both sides of the light-emitting material.

The electrodes can be placed on both sides of the light-emitting material, as shown in FIG. 12. One set of electrodes 140 has positive polarity, and another set of electrodes 144 on an opposite side of the light-emitting material 150 has negative polarity. In this instance, one of the electrodes would be constructed of transparent or translucent materials so as to pass light from the light-emitting material 150. Suitable transparent or translucent electrodes would be manufactured of conductive polymers or metal oxides. Other materials are possible. The provision of electrodes on both sides of the light-emitting material 150 permits the use of a thicker layer of light-emitting material, since the field generated between the opposing electrodes will penetrate the light-emitting material to a greater extent than if the electrodes were provided on the same side.

The energy loss at the electrode in lighting systems according to the invention is reduced because of the large effective surface area. The invention is lightweight because of the displacement of solid material by gas, resulting in a favorable weight per lumen ratio. No separate support system for light tubes is required, as with fluorescent lights. Accordingly, the need for structural supports is reduced. The electrodes are not in contact with the luminous gas, and there is no electrode and gas degradation mechanism. There is also no possibility of failure in a glass to metal seal, which is possible with fluorescent lighting systems. The invention also has the unusual feature of being operational even when the luminous material has been cracked, as gas bubbles remaining in the broken pieces will continue to function as a light source.

This invention can be embodied in other specific forms without departing from the spirit or essential attributes thereof, and accordingly, reference should be had to the following claims, rather than the foregoing specification, as indicating the scope of the invention.

I claim:

1. A lighting system, comprising:

a light-emitting material comprising an electrically insulating optical material having a plurality of gas compartments formed therein, and having a luminous composition within the compartments, said optical material being glass; and at least one structure for passing RF radiation through at least a portion of said compartments in said light-emitting material, whereby said luminous composition in said compartments will emit light through said optical material.

2. The lighting system of claim 1, wherein said luminous composition is a gas and said compartments are provided as bubbles.

3. The lighting system of claim 1, wherein said luminous composition is a gas selected from the group consisting of neon, krypton, xenon and mixtures thereof.

4. The lighting system of claim 1, wherein said at least one structure for passing RF radiation generates radio frequency excitation between about 200 kilohertz and about 30 megahertz.

5. The lighting system of claim 1, wherein said structure for passing RF radiation comprises electrodes.

6. The lighting system of claim 5, wherein at least one of said electrodes is made of at least one selected from the group consisting of conductive polymers and metal oxides.

7. The lighting system of claim 5, wherein said external electrodes are provided as a foil attached to the luminous material.

8. The lighting system of claim 7, wherein said foil is formed from at least one selected from the group consisting of aluminum and copper.

9. The lighting system of claim 5, wherein said external electrodes are attached to said luminous material by an adhesive.

10. The lighting system of claim 5, wherein said electrodes are formed in the optical material.

11. The lighting system of claim 1, wherein said compartments are coated with a fluorescent material.

12. The lighting system of claim 1, wherein said compartments are coated with a phosphorescent material.

13. The lighting system of claim 1, further comprising at least one shield to prevent electro-magnetic interference.

14. The lighting system of claim 13, wherein said at least one shield comprises at least one selected from the group consisting of metals and conducting transparent films.

15. The lighting system of claim 1, wherein said compartments are larger than the electron mean-free path of the luminous gas when ionized.

16. A lighting system, comprising:

a light-emitting material comprising an electrically insulating optical material having a plurality of enclosed capsules of an optical material;

a luminous composition being contained within said capsules, said capsules being embedded within the optical material of said light-emitting material; and, at least one structure for passing RF radiation through at least a portion of said capsules in said light-emitting material, whereby said luminous composition in said capsules will emit light through said optical material.

17. The lighting system of claim 1, wherein said compartments are provided at least in part as pre-formed sections made from said optical material.

18. The lighting system of claim 1, wherein said structure for passing RF radiation comprises electrodes, and said lighting system comprises layers of said light-emitting material, with said electrodes interspersed between said layers.

19. The lighting system of claim 1, wherein said structure for passing RF radiation comprises electrodes, and electrodes of opposite polarity are provided on opposite sides of said light-emitting material.

20. A lighting system, comprising:

a light-emitting material comprising an electrically insulating optical material having a plurality of gas compartments formed therein, and having a luminous composition within the compartments, said luminous composition within said compartments at a pressure between about 1 torr and 20 torr; and, at least one structure for passing RF radiation through at least a portion of said compartments in said light-emitting material, whereby said luminous composition in said compartments will emit light through said optical material.

21. A method of making a lighting system, comprising the steps of:

providing an electrically insulating optical material in the liquid state;

entraining in said optical material bubbles of luminous gas at a pressure between about 1 torr and 20 torr;

solidifying the optical material to seal the luminous gas in the material, and forming a light-emitting material; and affixing electrodes to the light-emitting material to permit the passage of RF radiation through at least a portion of the bubbles, whereby the luminous gas will be ionized and will emit light through said light-emitting material.

22. A method of making a lighting system, comprising the steps of:

providing a plurality of enclosed capsules of an optical material, said capsules containing a luminous composition;

embedding said capsules in an optical material that is in the liquid state;

solidifying the optical material to seal the capsules containing the luminous composition within the solidified optical material, forming a light-emitting material; and affixing electrodes to the light-emitting material to permit the passage of RF radiation through at least a portion of the capsules, whereby the luminous composition will be ionized and will emit light through said light-emitting material.

23. A method of making a lighting system, comprising the steps of:

providing pre-formed sections of an optical material, said pre-formed section having structure defining in part a plurality of partial compartments, said sections being matable to one another so as to form enclosed compartments;

mating said sections in the presence of an atmosphere containing a luminous gas at a pressure between about 1 torr and 20 torr, whereby said sections will mate to form a plurality of enclosed compartments containing said luminous gas;

affixing electrodes to at least one of the sections to permit the passage of RF radiation through at least a portion of the enclosed compartments, whereby the luminous gas will be ionized and will emit light through said optical composition.

24. A light-emitting material comprising an electrically insulating optical material having a plurality of enclosed capsules of an optical material, each capsule containing a luminous composition capable of emitting light when irradiated by radio frequency radiation.

* * * * *